United States Patent [19]

Roy et al.

[11] Patent Number: 4,672,384

[45] Date of Patent: Jun. 9, 1987

[54] CIRCULARLY POLARIZED RADIO FREQUENCY ANTENNA

[75] Inventors: Albert A. Roy, Lompoc; George J. Monser, Goleta, both of Calif.

[73] Assignee: Raytheon Company, Lexington, Mass.

[21] Appl. No.: 687,685

[22] Filed: Dec. 31, 1984

[51] Int. Cl.[4] ..... H01Q 13/02

[52] U.S. Cl. ..... 343/725; 343/786; 343/829

[58] Field of Search ..... 343/786, 797, 756, 829, 343/725, 724

[56] References Cited

U.S. PATENT DOCUMENTS

| | | | |
|---|---|---|---|
| 2,825,060 | 2/1958 | Ruze | 343/756 |
| 3,623,112 | 11/1971 | Rupp | 343/727 |
| 4,141,012 | 2/1979 | Hockham et al. | 343/729 |
| 4,218,685 | 8/1980 | Frosch | 343/797 |
| 4,353,072 | 10/1982 | Monser | 343/725 |
| 4,353,074 | 10/1982 | Monser et al. | 343/786 |

*Primary Examiner*—Eli Lieberman

*Attorney, Agent, or Firm*—Richard M. Sharkansky; Denis G. Maloney; Peter J. Devlin

[57] ABSTRACT

A radio frequency antenna is provided comprising: a waveguide section; first means for establishing radio frequency energy in such waveguide section having a first linear polarization with an electric field disposed normal to opposing wide walls of the waveguide section; a planar microwave circuit means, for establishing a second linear polarization having an electric field disposed perpendicular to the electric field of the first linear polarization, such microwave circuit means being disposed within the waveguide between the wide walls and relative to the feed means to provide the first linear polarization and the second linear polarization with substantially coincident phase centers. In a preferred embodiment of the invention, the microwave circuit means includes a strip conductor feed separated from a ground plane conductor by a dielectric, such ground plane conductor having a notch formed therein and fed by the strip conductor. More particularly, the dielectric is a planar sheet of dielectric material having the ground plane conductor formed on one surface thereof and the strip conductor feed formed on the other surface thereof. The first feed means launches the first linearly polarized energy with the electric field disposed in the E-plane of the waveguide and the planar dielectric sheet is disposed in the H-plane of the waveguide. The first feed means and the strip line feed are feed signals having a ninety degree phase shift therebetween. With such arrangement, a relatively simple feed structure is provided.

13 Claims, 10 Drawing Figures

CIRCULARLY POLARIZED RADIO FREQUENCY ANTENNA

BACKGROUND OF THE INVENTION

This invention relates generally to radio frequency antenna and more particularly to radio frequency antenna adapted to operate with circular polarization.

As is known in the art, it is frequently desirable to provide a radio frequency antenna adapted to operate with circular polarization. One such antenna is described in U.S. Pat. No. 4,353,072, entitled "Circularly Polarized Radio Frequency Antenna", issued Oct. 5, 1982, inventor George J. Monser and assigned to the same assignee as the present invention. As described therein, the radio frequency antenna includes an antenna element having a forward, open-ended waveguide section, the upper and lower relatively wide side walls thereof being provided by the ground planes of a pair of microwave circuits. A first feed is disposed adjacent the rearward end of the waveguide section for radiating radio frequency energy having an electric field normal to the upper and lower wide walls of the waveguide section (i.e., a vertical polarization having a phase center at the center of the open-ended waveguide). Each one of the pair of microwave circuits includes a strip transmission line circuit having disposed adjacent the forward, open-ended waveguide section an array of radiating elements and a rearward feed for radiating from the array of radiating elements radio frequency energy having an electric field parallel to the plane of the upper and lower side walls (i.e., a horizontal polarization). Thus, by feeding equal, in-phase signals to the pair of microwave circuits and by feeding a 90° phase shifted signal to the first feed, circularly polarized energy is radiated by the antenna element. Further, with such arrangement, the resultant phase center of the horizontally polarized energy is disposed at the center of the open-ended waveguide and, therefore, both the horizontal and vertical polarization components have coincident phase centers. While such antenna element does provide circular polarization, when used in relatively large arrays, a relatively large power distribution network is required to feed equal signals to each of the pair of microwave circuits of each of the antenna elements in the array. Further, such network may add loss and unwanted phase shift which with increasing scan angles, leads to non-coincident phase center and reduced quality of the circular polarization.

SUMMARY OF THE INVENTION

In accordance with the present invention, a radio frequency antenna is provided comprising: a waveguide section; first means for establishing radio frequency energy in such waveguide section having a first linear polarization with an electric field disposed normal to opposing wide walls of the waveguide section; a planar microwave circuit means, for establishing a second linear polarization having an electric field disposed perpendicular to the electric field of the first linear polarization, such microwave circuit means being disposed within the waveguide between the wide walls and relative to the feed means to provide the first linear polarization and the second linear polarization with substantially coincident phase centers.

In a preferred embodiment of the invention, the microwave circuit means includes a strip conductor feed separated from a ground plane conductor by a dielectric, such ground plane conductor having a notch formed therein and fed by the strip conductor. More particularly, the dielectric is a planar sheet of dielectric material having the ground plane conductor formed on one surface thereof and the strip conductor feed formed on the other surface thereof. The first feed means launches the first linearly polarized energy with the electric field disposed in the E-plane of the waveguide and the planar dielectric sheet is disposed in the H-plane of the waveguide. The first feed means and the strip line feed are feed signals having a ninety degree phase shift therebetween. With such arrangement, a relatively simple feed structure is provided.

In accordance with an additional feature of the invention, the ground plane of the microwave circuit is dielectrically spaced from the narrow side walls of the waveguide. The strip conductor of the microwave circuit passes through one of the sidewalls of the waveguide and such portion of the strip conductor is provided with a ground plane dielectrically spaced from the ground plane of the microwave circuit to maintain the dielectric separation between the sidewalls and the ground plane of the microwave circuit.

In accordance with a further additional feature of the invention, the front ends of the upper and lower wide walls of the waveguide have non-overlaying regions to provide a balance between the gain of the waveguide and the gain of the microwave circuit.

BRIEF DESCRIPTION OF THE DRAWINGS

The foregoing features of this invention, as well as the invention itself, may be more fully understood from the following description read together with the accompanying drawings in which.

DESCRIPTION OF THE PREFERRED EMBODIMENT

Figure 1:
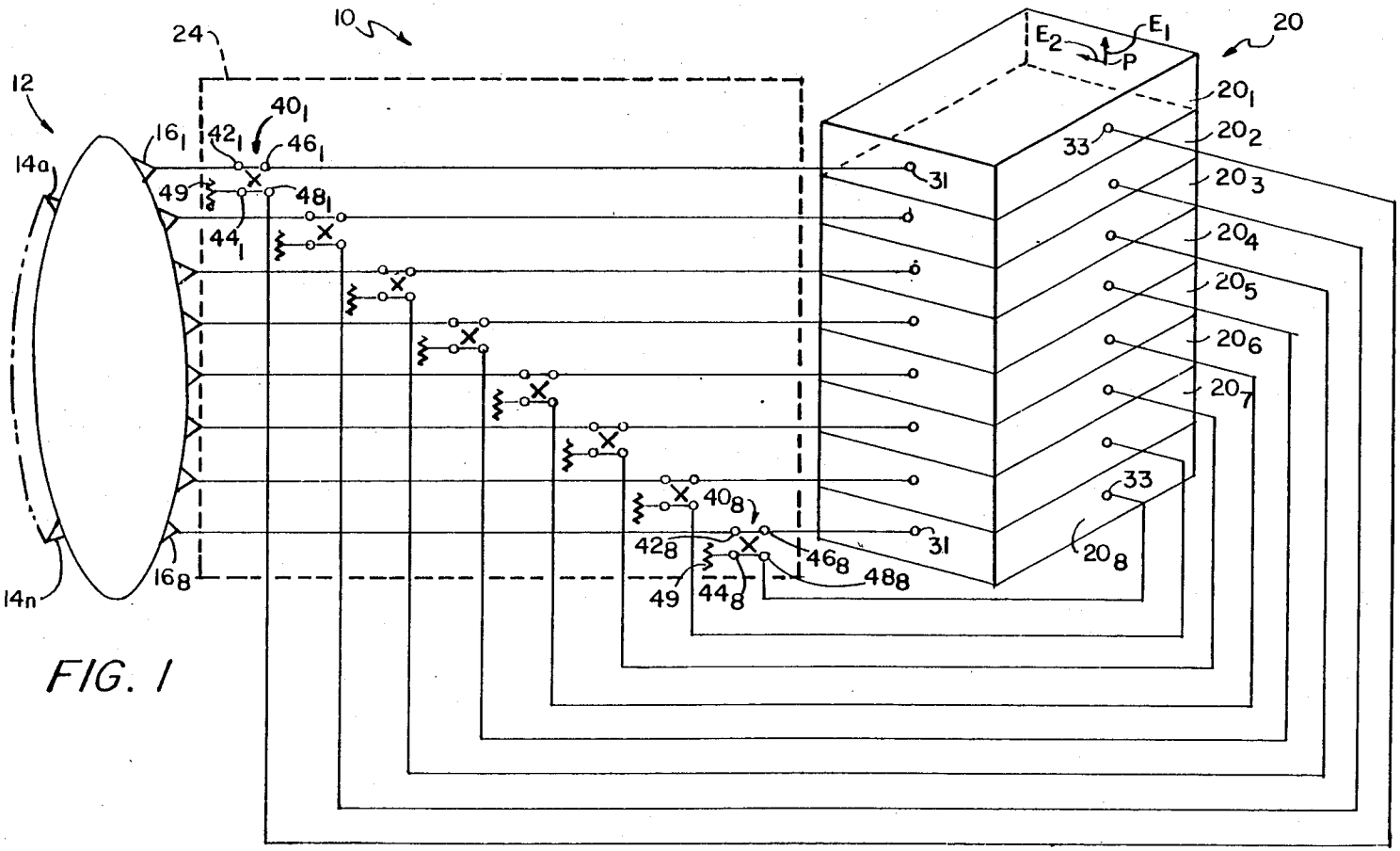
FIG. 1 is a schematic diagram of a radio frequency antenna system including an array of antenna elements according to the invention.

Referring now to FIG. 1, a multibeam radio frequency antenna system 10 is shown to include to include a radio frequency lens 12 having a plurality of feed ports 14*a*–14*n* disposed along a portion of the periphery of such lens 12 and a plurality of, here eight array ports $16_1$–$16_8$ disposed along an opposing portion of the periphery of the lens 12, the plurality of array ports $16_1$–$16_8$ being coupled to an array 20 of a plurality of, here eight, identically constructed antenna elements $20_1$–$20_8$ through a power distribution network 24, the details of which will be described hereinafter. Suffice it to say here, however, that the shape of the lens 12, the construction of the power distribution network 24 and the arrangement of the antenna elements $20_1$–$20_8$ are selected such that n collimated beams of radio frequency energy are formed in free space, each one of such n beams having a different direction and each one of such n beams having circularly polarized radio frequency energy.

Figure 2:
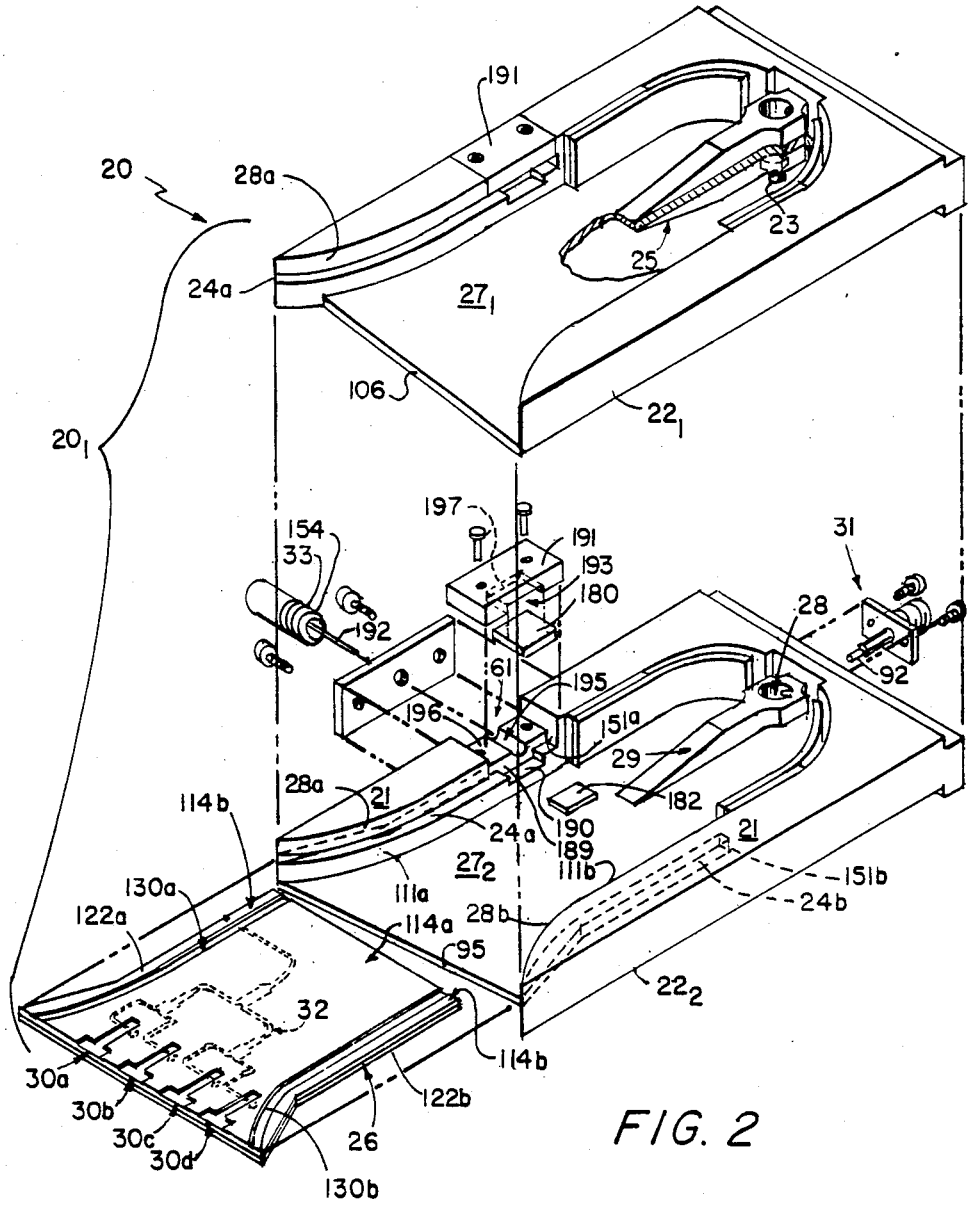
FIG. 2 is an exploded isometric drawing, partly broken away, of an exemplary one of the antenna elements in the array of FIG. 1.

Referring now to FIG. 2, an exemplary one of the plurality of identically constructed antenna elements $20_1$–$20_8$, here antenna element $20_1$, is shown in detail to include a pair of substantially identically (except for the front edges for reasons to be described hereinafter) constructed conductive members $22_1$, $22_2$. When the bottom plate $27_1$ of member $22_1$ is disposed on the top surface 21 of member $22_2$, the post 23 of the upper tapered ridge 25 formed on the bottom plate $27_1$ of member $22_1$ is disposed within the aperture 28 formed on the lower tapered ridge 29 formed on the upper surface of bottom plate $27_2$ of member $22_1$ (FIGS. 3 and 6) a rectangular cross-section, waveguide is formed having an open front end and a rearward, double ridge feed fed via coaxial connector 31 as described in our U.S. Pat. No. 4,353,074, entitled "Radio Frequency Ridged Waveguide Antenna", issued Oct. 5, 1982, and assigned to the same assignee as the present invention. Such formed waveguide is thus adapted to transmit and/or receive radio frequency energy having a linear polarization with the electric field thereof in the E-plane, i.e., in a vertical plane perpendicular to the planes of the plates $27_1$, $27_2$ of members $22_1$, $22_2$ which form the opposing wide walls of the waveguide, as shown by the vector $E_1$ in FIG. 1. Slots 24*a*, 24*b* (FIGS. 2, 3, 5 and 6) are formed in the sidewalls 28*a*, 28*b* of member $22_2$. The formed slots 24*a*, 24*b* are disposed midway between the top surface portions 21 of member $22_2$ and the upper surface portion of bottom plate $27_2$ of member $22_2$. Disposed within slots 24*a*, 24*b* formed in the frontal portion of the opposing narrow sidewalls 28*a*, 28*b* of member $22_2$ is a planar microstrip circuit 26, here a strip transmission line circuit having a plurality of, here four, flared notch-shaped antenna elements 30*a*–30*d* similar to that described in U.S. Pat. No. 4,353,072 for providing radio frequency energy having a linear polarization with the electric field thereof disposed in the H-plane (i.e., horizontal) of the waveguide (as described in U.S. Pat. No. 4,353,072) and having a phase center midway between the sidewalls 28*a*, 28*b* of the formed waveguide as shown by the vector $E_2$ in FIG. 1. The microstrip circuit 26 is also fed through a feed structure 32 similar to that described in U.S. Pat. No. 4,353,072. It is noted that here, however, such microstrip circuit 26 is fed by a feed structure 32 which feeds energy through one of the sidewalls 28*a*, 28*b* (here the left sidewall 28*a*) via a coaxial connector 33. It is also noted that here the planar microstrip circuit 26 is disposed in a plane positioned midway between the upper and lower opposing widewalls of the formed waveguide. Thus, the phase center of the horizontally polarized energy provided by the strip transmission line circuit 26 is a vertical plane, symmetrically disposed between the upper and lower opposing wide walls of the formed waveguide. Further, the phase center of the vertically polarized energy provided by the double ridges 25, 29 is also midway between the opposing upper and lower wide walls $27_1$, $27_2$. The double ridges 25, 29 are disposed midway between the narrow sidewalls 28*a*, 28*b*. Thus, the vertically polarized radio frequency energy provided by the double ridge fed waveguide formed by the pair of conductive members $22_1$, $22_2$ and the horizontally polarized radio frequency energy provided by the microwave circuit 26 have coincident phase centers at point P, such point being at the center of the front end of the formed waveguide as shown in FIG. 1. Thus, by feeding signals to the formed double ridge fed waveguide and the microwave circuit with equal power and with a $\pi/2$ radian phase shift therebetween, such antenna element $20_1$ produces circularly polarized radio frequency energy.

Referring again to FIG. 1, such power division and phase shifting is provided by the power distribution network 24. The power distribution network 24 includes a plurality of, here eight, quadrature hybrid couplers $40_1$–$40_8$, each having a pair of input terminal $42_1$, $44_1$ to $42_8$, $44_8$ and a pair of output terminals $46_1$, $48_1$ to $46_8$, $48_8$. One of the pair of input terminals $42_1$–$42_8$ is coupled to a corresponding one of the array ports $16_1$–$16_8$, as shown, and the other one of the pair of input terminals $44_1$–$44_8$ is terminated in a matched load 49, as shown. Hence, power fed to the couplers $40_1$–$40_8$ is divided equally between a pair of output ports $46_1$, $48_1$ to $46_8$, $48_8$, but the signals at the output ports $46_1$–$46_8$ differ in phase from the signals at output ports $48_1$–$48_8$ by ninety degrees. The output ports $46_1$–$46_8$ are fed to the coxial axial connectors 31 of elements $20_1$–$20_8$, respectively, and hence to the double ridge feeds of the waveguide and the output ports $48_1$–$48_8$ are fed to the coaxial connectors 33 of elements $20_1$–$20_8$, respectively, and hence to the microstrip circuits 26 to thereby provide the desired 90 degree relative phase shift between the signal fed to the double ridge feed at the rear end of the formed waveguides and the signal fed to the microwave circuits and thus enable production of the desired circularly polarized radio frequency energy.

Figure 3:
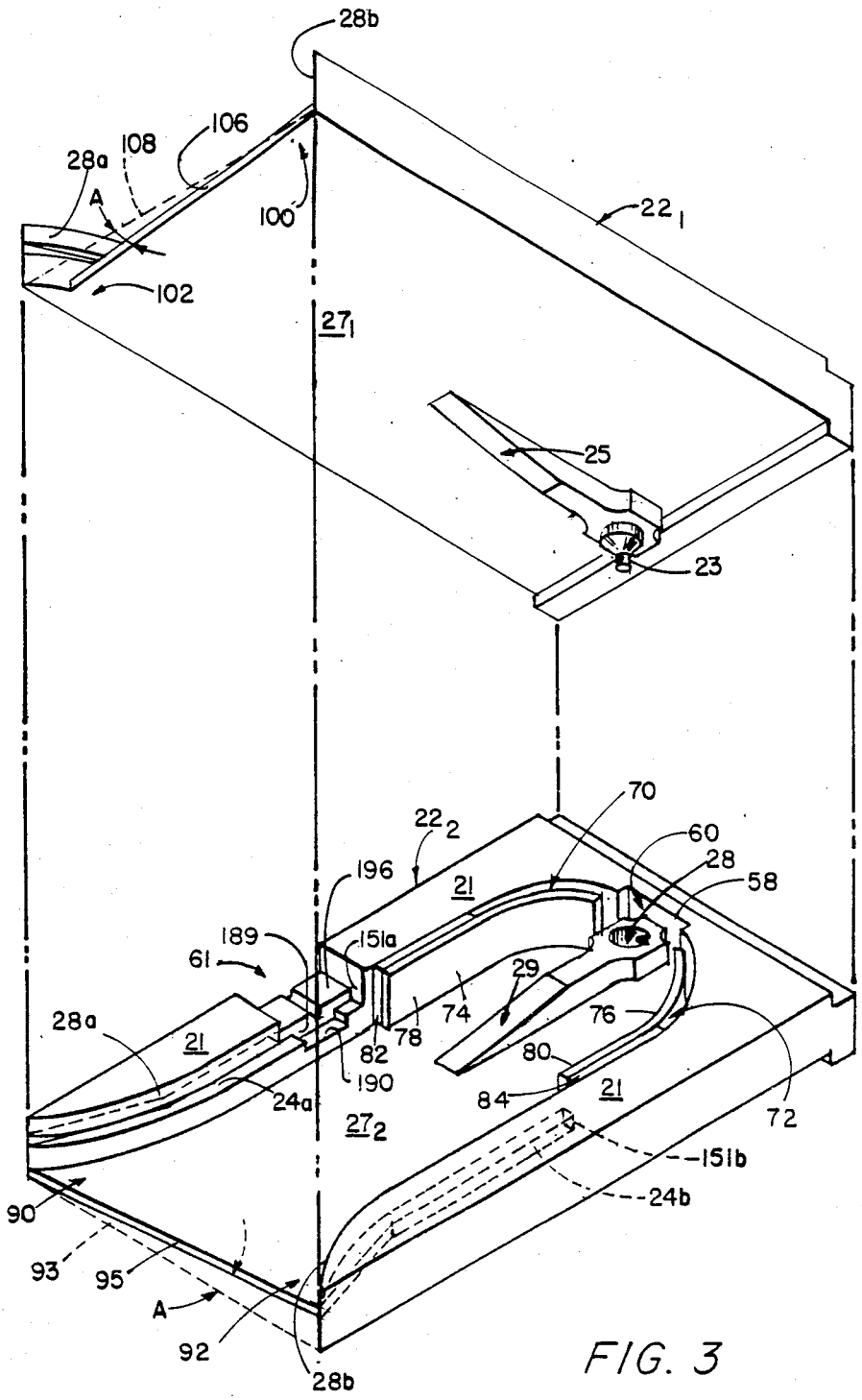
FIG. 3 is an exploded isometric view of a pair of adjacent conductive members which, when affixed to each other, form an open-ended, double ridge fed waveguide portion of the antenna element of FIG. 2.

Referring now in more detail to FIG. 3, each one of such members $22_1$, $22_2$ is constructed from a block of electrically conductive material, here aluminum. The upper surface 21 of such block has machined therein S-shaped side walls 28*a*, 28*b* and a rear wall portion 58 has a recess or notch 60 formed therein. Also machined into the upper surface 21 of the members $22_1$, $22_2$ is the tapered ridge 29, as shown. The tapered ridge 29 has aperture 28 formed in the upper, flat top portion thereof, the flat top portion terminating in a tapered portion, as shown. It is noted that the separation between the opposing narrow side walls $28_a$, $28_b$ disposed laterally of the tapered portion of ridge 29 is relatively constant, however, such separation decreases, here along a curved paths, as such rear wall portions extend towards the rear wall 58. Member $22_2$ also has slots 24*a*, 24*b* machined into the side walls 28*a*, 28*b* thereof. Such slots 24*a*, 24*b* are, as described above, midway between the upper surface of the bottom plate $27_2$ of member $22_2$ and the bottom surface of the bottom plate $27_1$ of member $22_1$. Disposed along the curved regions of the side walls 28*a*, 28*b* are open ended channels 70, 72. Channels 70, 72 are here formed of curved conductive strips 74, 76, here aluminum having ends 78, 80 spaced from, and affixed to side walls 28*a*, 28*b* respectively. The spacing is provided by aluminum spacers 82, 84, such ends 78, 80 and spacers 82, 84 being affixed to the side wall portions through a convenient means as by bolts or a suitable electrically conductive epoxy, not shown. The channels 70, 72 are effective in removing unwanted surface currents produced along the side walls 28*a*, 28*b*, as described in the above-referenced U.S. Pat. No. 4,353,074.

Figure 4:
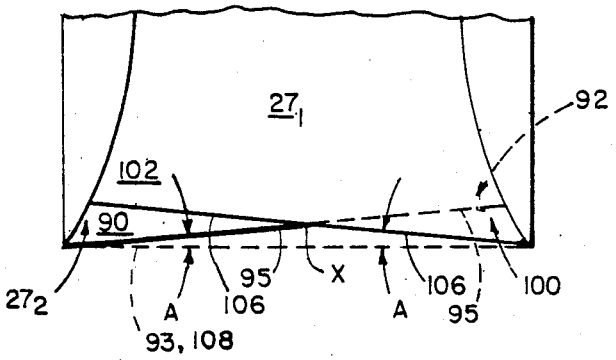
FIG. 4 is a top plan view of the front portion of the open-ended waveguide formed by the affixed conductive members of FIG. 3.

The side walls 28*a*, 28*b* disposed between the tapered ridge 29 and the frontal end of the member $22_2$ are flared outwardly along a nonlinear path to increase the surface length of the side walls 28*a*, 28*b* from the tapered ridge 29 to free space within the fixed longitudinal length of the antenna element $22_1$ thereby providing a relatively compact antenna element with a side wall length sufficiently long to provide an adequate transition region between the tapered ridge and free space. It is noted that while the left hand portion 90 of the bottom plate $27_2$ of member $22_2$ extends to the front end of the left side wall 28*a*, the right hand portion 92 of the bottom plate $27_2$ terminates a predetermined distance from the front end of the right side wall 28*b*. Thus, while the front ends of the opposing side walls 28*a*, 28*b* are disposed along dotted line 93, the front edge 95 of the bottom plate $27_2$ is disposed at an angle A with respect to such dotted line 93. Further, considering the bottom plate $27_1$ of member $22_1$, it is noted that the right end 100 of the bottom plate $27_1$ extends to the end of the right side wall 28*b* of member $22_1$ while the left end 102 of the bottom plate $27_1$ is foreshortened. Thus, the front edge 106 of bottom plate $27_1$ makes also an acute angle A with respect to the dotted line 108 passing through the ends of the side walls 28*a*, 28*b* of the upper memeber $27_1$. Thus, referring to FIG. 4, when the upper and lower conductive members $22_1$, $22_2$ are joined together to form the open-ended waveguide, the frontal portion of the formed waveguide appears as shown in FIG. 4; that is, the front edges 95, 106 of the bottom plates $27_1$, $27_2$ forming the upper and lower side walls of the waveguide cross one another at a point X in the center of the waveguide so that the front portions 90, 100 of the wide walls are neither underlayed nor overlayed with a wide wall of the formed waveguide. More particularly, the right hand portion 100 (in FIG. 4) of the upper wide wall $27_1$ is not overlayed by the lower wide wall $27_2$ and the left hand portions 90 of the lower wide wall $27_2$ is not underlayed by the upper wide wall $27_1$. The degree of non-overlapping is a function of the shape of the edges 95, 106 and such is selected to provide a match between the antenna gain of the double-ridge fed waveguide portion of the antenna element and the antenna gain of the microstrip circuit antenna element; i.e., a match in gain between the horizontal and vertical polarization components of the radio frequency energy. More specifically, this allows the microstrip circuit gain to increase to the same level as the waveguide gain and closely follow the waveguide gain over the frequency band and over a field of view of approximately 90°. The gain of the waveguide is approximately the same as it would have been if the bottom plates $27_1$, $27_2$ were not foreshorted. It is noted that the left sidewall 28*a* (FIG. 2) of member $22_2$ is provided with a slot 61 which is used to accept a feed structure for the microwave circuit 26 (FIG. 2) and a portion of connector 33. Such slot 61 will be described in more detail hereinafter.

Referring again to FIG. 3, the bottom surface of bottom plate $27_1$ of member $22_1$ has the tapered ridge 25 formed thereon. The flat portion of the ridge 25 has the turret shaped conductive post 23 press fit therein by a pin shaped end as described in U.S. Pat. No. 4,353,074 referred to above. Post 23 has a hole drilled therein for receiving the center conductor 92 (FIG. 2) of the coaxial connector 31 as described in U.S. Pat. No. 4,353,074. It is noted from FIGS. 2, 3 and 6 that the tapered ridges 25, 27 formed on the upper and lower surfaces of member $22_1$ are in alignment or registration with each other. Further, it is evident that the post 23 of member $22_1$ fits into the aperture 28 of member $26_2$ as shown and as described in detail in U.S. Pat. No. 4,353,074.

Figure 8:
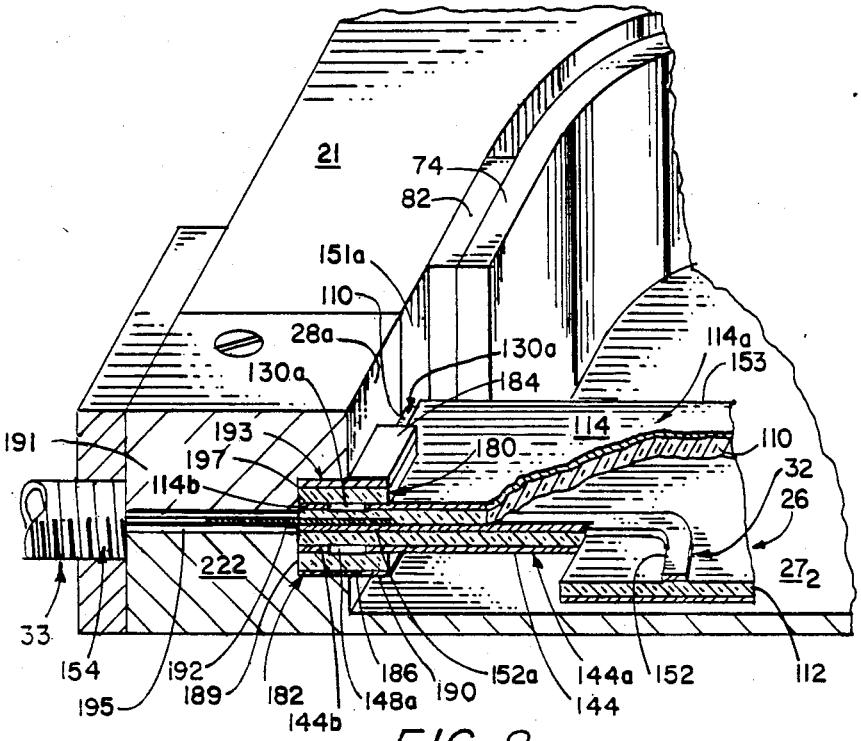
FIG. 8 is a perspective view partially broken away and showing in cross-section, a portion of the lower conductive member of FIG. 3 affixed to the strip transmission line feed network of FIG. 7, such view showing the connection of the strip transmission line circuit to a coaxial connector.
Figure 5:
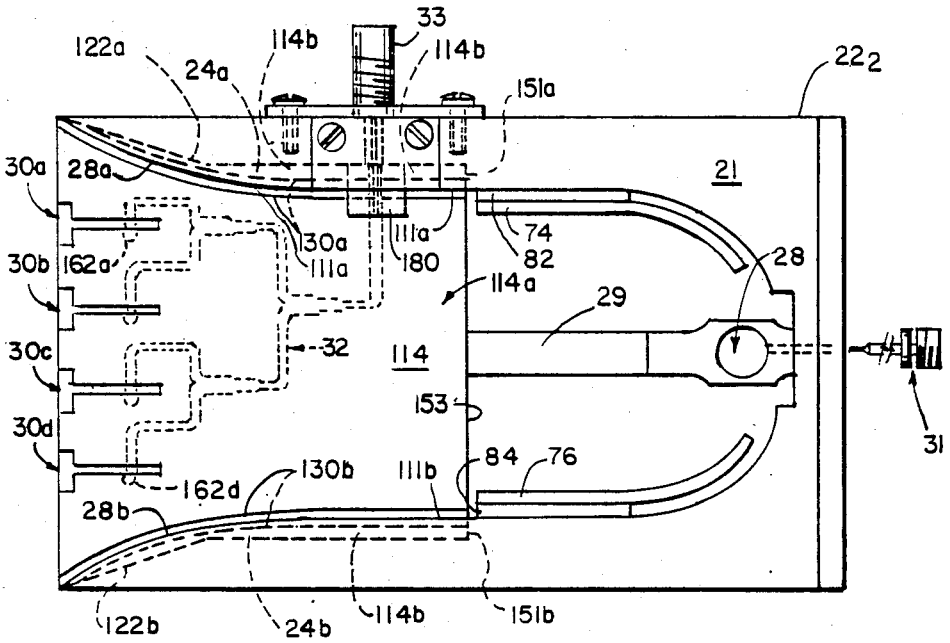
FIG. 5 is a top plan view of the bottom one of the pair of conductive members of FIG. 3.
Figure 6:
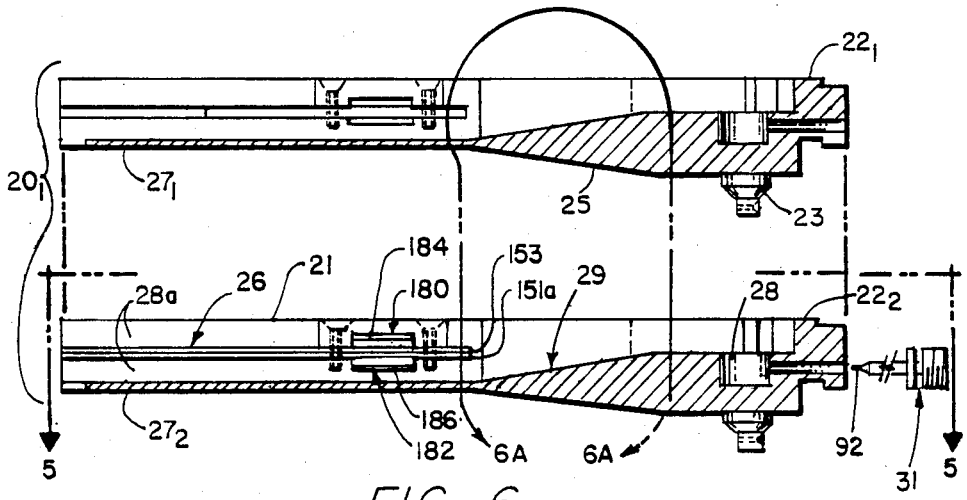
FIG. 6 is an exploded cross-sectional side elevation. view of the antenna element of FIG. 2 formed by the pair of conductive members of FIG. 3, such cross-section being taken along the longitudinal center line of the waveguide formed by the affixed pair of members.
Figure 7:
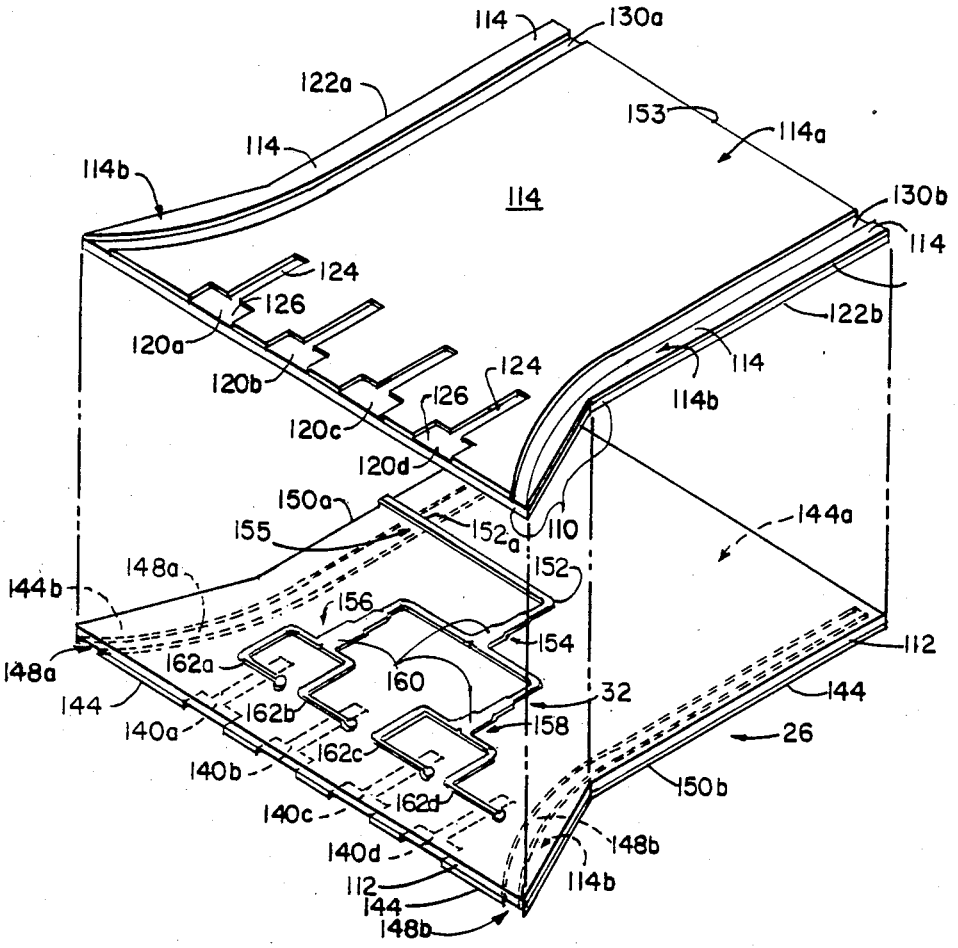
FIG. 7 is an exploded, isometric view of a strip transmission line feed network used in the antenna element of FIG. 2.
Figure 6A:
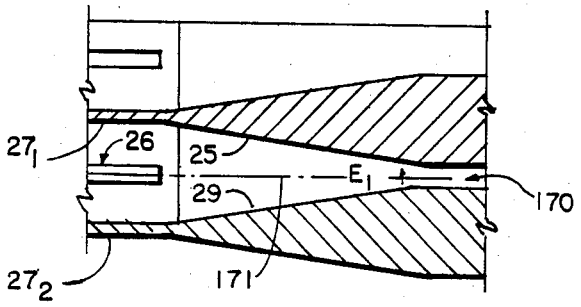
FIG. 6A is a cross-sectional view showing a portion of the antenna element of FIG. 2 when the pair of conductive members of FIG. 2 are mounted together and with the feed network of FIG. 7 disposed within such antenna element, such portion being of region 6A—6A of FIG. 6.

Referring now to FIG. 7, an exemplary one of the identically constructed strip transmission line circuits 26 used in each one of the antenna elements $20_1$–$20_8$ (FIG. 1), here the one used in element $20_1$, is shown in detail to include a pair of planar dielectric support structures or substrates 110, 112 of any suitable material, here Teflon Fiberglass material having a dielectric constant of 2.56. Initially, each one of the dielectric support structures 110, 112 has a sheet of conductive material, here copper clad on the upper and lower surfaces thereof. The sheet of conductive material on the lower surface of upper dielectric support structure 110 is removed entirely with a suitable chemical etchant whereas a plurality of here, four flared notches 120*a*–120*b* symmetrically disposed with respect to the edges 122*a*, 122*b* are etched into the conductive material 114 clad onto the upper surface of such upper dielectric support structure 110 using conventional photolithographic-chemical etching techniques. Each one of the notches 120*a*–120*d* has a narrow portion 124 and a wider portion 126. The notches 120*a*–120*d* are separated from each other a distance less than a half wavelength at the smallest operating wavelength of the antenna. Also etched in the conductive material 114 are a pair of slots 130*a*, 130*b* disposed a predetermined distance from the side edges 122*a*, 122*b* of the support 110. The distance is selected so that when circuit 26 is inserted into slots 24*a*, 24*b* (FIG. 2), the inner surfaces 111*a*, 111*b* of the sidewalls 28*a*, 28*b* are in the middle of the slots 122*a*, 122*b* (FIG. 5) particularly in the region when circuit 26 is fed via connector 33. Considering now the second one of the pair of dielectric support structure 112 a similar pattern of four flared notches 140*a*–140*d* is etched into the conductive sheet 144 clad to the bottom surface of such dielectric support structure 112. Each one of the notches 140*a*–140*d* is identical to the notches 120*a*–120*d* formed on the conductive sheet 114 clad to the upper surface of dielectric support 110. Also etched in the conductive sheet 148*a*, 148*b* is a pair of slots spaced the same predetermined distance from the sides 150*a*, 150*b* of the support 112 as slots 130*a*, 130*b*. The conductive sheet initially clad to the upper surface of the dielectric support structure 112 is etched to form a feed network 32. The feed network 32 is a strip transmission line circuit having strip conductor 152 disposed between a pair of ground plane conductors formed by the conductive sheets 114, 144, (except for the region 155 where the portion 152*a* of strip conductor 152 passes through slots 130*a*, 148*a* (FIG. 8)) and separated from such sheets 114, 144 by the dielectric support structures 110, 112. The feed network 32 includes a first two-to-one power divider section 154 the output of which in turn feeds a pair of two-to-one power divider sections 156, 158. Each one of the three power divider sections 154, 156, 158 includes a step-matching transformer section 160. Thus, power fed to the strip transmission line feed network 32 is divided equally, and in phase, to each one of four feed lines 162*a*–162*d*. Each feed line 162*a*–162*d* is disposed underneath the narrow portions 124 of notches 120*a*–120*d* and hence the narrow portions of elements 30*a*–30*d*, as shown in FIG. 5, because the notches 120*a*–120*d* in conductive sheet 114 being in registration with notches 140*a*–140*d* formed in conductive sheet 144 form such flared notched antenna elements 30*a*–30*d*. (It is also noted that the pair of slots 130*a*, 130*b* are also aligned over slots 148*a*, 148*b*, respectively). It is noted that the strip conductor 152 fed to the two-to-one power divider 154 extends towards, and exits from the left edges 122*a*, 150*a* of the circuit. It is also noted that as the portion 152*a* of strip conductor 152 passes between the pair of slots 122*a*, 148*a* (i.e., through region 155) formed in the upper and lower ground planes 114, 144 of the strip transmission line circuit 26, such strip conductor portion 152*a* is without upper and lower ground planes. The slots 122*a*, 122*b*, 148*a*, 148*b* are formed in the upper and lower ground planes of the strip transmission line circuit so that the inner regions 114*a*, 144*a* of the ground planes 114, 144 are dielectrically separated (via substrates 110, 112) from outer regions 114*b*, 144*b* and when the circuit 26 is inserted into the slots 24*a*, 24*b* formed in the side walls of member $22_2$ (FIG. 2), the ground planes of the strip transmission line circuit 26 formed by sheets 114, 144 are insulated from the conductive side walls 28*a*, 28*b* by the dielectric of substrates 110, 112. It is noted that the back walls 151*a*, 151*b* (FIGS. 3, 5) of slots 24*a*, 24*b* prevent the back edge 153 of circuit 26 from contacting the spacers 82, 84 and strips 74, 76. More particularly, by merely placing the microwave circuit 26 midway between the upper and lower wide walls of the formed waveguide and with the upper and lower ground planes of the microwave circuit of feed 32 in contact with the narrow side walls 28*a*, 28*b*, a gain drop in the waveguide portion was experienced and the bandwidth was limited to about one octave. But, with the ground planes of feed 32 isolated from the narrow side walls 28*a*, 28*b*, the gain drop out was substantially removed. However, in order to provide ground planes above and below the strip conductor portion 152*a*, a pair of dielectric slabs 180, 182 (FIGS. 2 and 6) having copper 184, 186 (FIGS. 6 and 8) clad on one surface thereof is provided. More particularly, upper dielectric slab 180 has copper 184 clad to the upper surface thereof and lower dielectric slab 182 has copper 186 clad to the bottom surface thereof. The left bottom portion (FIGS. 2 and 8) of slab 182 rests on a flat region 190 formed in conductive member $22_2$. Thus, referring to FIGS. 2 and 8, the dielectric slabs 180, 182 bridge the slots 130*a*, 148*a* formed in the ground planes 114, 144 of the feed 32 of microstrip circuit 26 and the copper 184, 186 clad to the upper and lower surfaces of the slabs 180, 182, respectively, provide a continuous (albeit elevated) ground plane for the strip conductor portion 152*a*. The slabs 180, 182 are held into place by a conductive cap 191, as indicated. More particularly, the bottom of cap 191 has a recess 193 for receiving the top, copper 184 clad portion of slab 180. It is also noted that a groove 195 (FIG. 2) is formed in a flat section 196 for receiving the front portions of connector 33. It is noted that cap 191 is shaped so that a left wall 197 of slot 193 contacts the left portion of the copper 184 on slab 180 and to also contact the left edge of the outer portion 114*b* of clad copper 114. Further, the sidewall $22_2$ is shaped (FIG. 8) so that the back wall 189 of flat 190 makes contact with the left portion of the copper 186 clad to the bottom of slab 182 and also to contact the outer portion 144*b* of the clad copper 144. Thus, a coaxial cable connector 33 has the center conductor 192 connected to the left end of the strip conductor portion 152*a* and the insulated (via hole 195) outer conductor 154 of such connector 33 is electrically connected to conductive mounting block 192 and member $22_2$ and hence to the copper 184, 186 clad to the upper and lower slabs 180, 182 and to the outer portions 114*b*, 144*b* of clad copper 114, 144. The copper 184, 186 clad to the slabs 180, 182 thus bridge slots 130*a*, 148*a* to provide a continuous, elevated, ground plane for the strip conductor portions 152*a* but the ground planes (i.e., the inner portions 114*a*, 144*a* of the clad copper 114, 144 (FIG. 7)) of the feed 32 of the strip transmission line circuit 26 are dielectrically spaced (i.e., isolated) from the narrow sidewall 28*a*, thus substantially removing any gain drop out which would have resulted by not having slots 130*a*, 130*b*, 148*a*, 148*b*. One may consider that the copper 184, 186 clad to dielectric slabs 180, 182 provide capacitive coupling to the feed 32. When strip transmission line feed network 26 is fed radio frequency energy from a coaxial connector 33 (FIG. 8), the strip transmission line circuit 26 couples energy to the notched antenna elements 30*a*–30*d* whereupon such feed energy is then radiated into free space with an electric field vector disposed in the plane of the strip transmission line circuit 26 as shown by the vector $E_2$ in FIG. 1. Thus, the energy radiated by the notches is linearly polarized; more particularly, here horizontally polarized. It is also noted from FIGS. 6 and 6A that when the bottom plate $27_1$ rests on top surface 21 of member $22_2$, a gap 170 is formed between the flat portions of the tapered ridges 25, 29, as described in U.S. Pat. No. 4,353,074. This gap 170 is used to establish a vertical electric field $E_1$. It is noted that gap 170 is disposed along the coaxial center line 171 of the waveguide. It is also noted that the plane of the microwave circuit 26 is disposed in alignment with the gap 170, that is, the plane of circuit 26 is parallel to bottom plates $27_1$, $27_2$ and is also disposed along the axial center line 171 of the waveguide, i.e., in line with the gap 170. Thus, the electric field E2 produced by circuit 26 and the field $E_1$ produced by the gap 170 in the formed waveguide are coincident and in the center of the formed waveguide.

Figure 9:
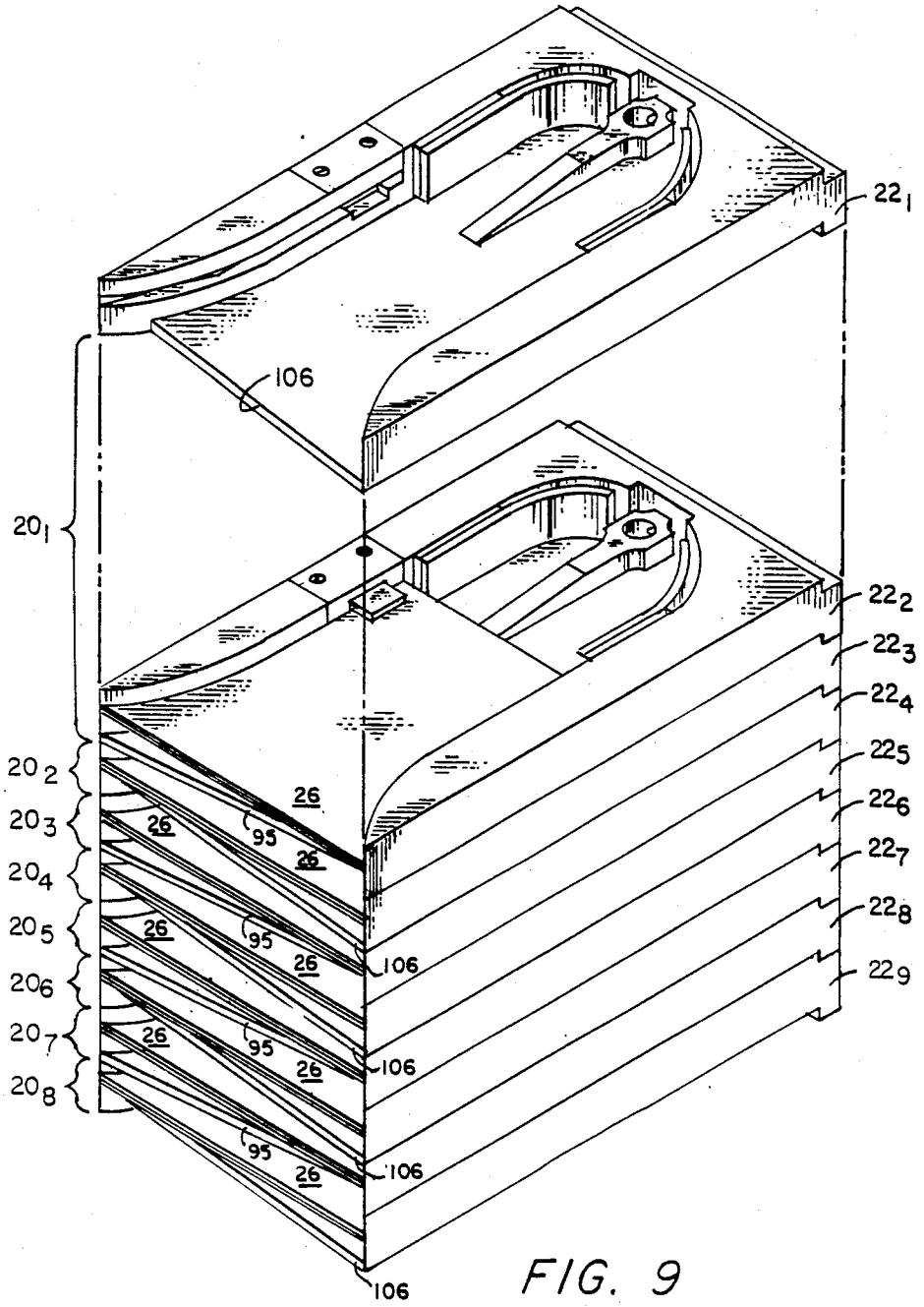
FIG. 9 shows an array of antenna elements of FIG. 2.

Referring now to FIG. 9, the array 20 of the antenna element $20_1$–$20_8$ is shown. It is noted that conductive members $22_3$, $22_5$, $22_7$, $22_9$ are identical to conductive member $22_1$ (including the front edges 106 thereof) and conductive members $22_4$, $22_6$, $22_8$) are identical to conductive member $22_2$ (including the front edges 95 thereof). Each of the microwave circuits 26 at each one of the elements $20_1$–$20_8$ is identical.

Having described a preferred embodiment of the invention, it is now evident that other embodiments incorporating these concepts may be used. Thus, for example, while the edges 95, 106 are linear, other shapes may be used. It is felt, therefore, that the invention should not be restricted to the described embodiment, but rather should be limited only by the spirit and scope of the appended claims.

What is claimed is:

1. A radio frequency antanna comprising:

(a) a waveguide section comprising a pair of opposing, relatively wide walls and a pair of opposing, relatively narrow side walls;

(b) first feed means for establishing radio frequency energy in such waveguide section having a first linear polarization with an electric field disposed normal to the opposing wide walls of the waveguide section; and (c) a planar microwave circuit means, for establishing radio frequency energy having a second linear polarization with an electric field disposed perpendicular to the electric field of the first linear polarization, such microwave circuit means comprising a strip conductor feed separated from a ground plane conductor by a dielectric, said microwave circuit means being disposed within the waveguide section intermediately between the opposing, relatively wide walls thereof with the ground plane conductor of the planar microwave circuit means being dielectrically spaced from the pair of opposing, relatively narrow side walls.

2. The antenna recited in claim 1 wherein the ground plane conductor has a notch formed therein, said notch being fed by the strip conductor feed.

3. The antenna recited in claim 2 wherein the dielectric is a planar sheet of dielectric material having the ground plane conductor formed on one surface thereof and the strip conductor feed formed on the other surface thereof and wherein the first feed means launches the first linearly polarized energy with the electric field disposed in the E-plane of the waveguide and the planar dielectric sheet is disposed in the H-plane of the waveguide.

4. The antenna recited in claim 3 wherein a portion of the strip conductor feed of the planar microwave circuit means passes through one of the pair of relatively narrow side walls of the waveguide section, and wherein such portion of the strip conductor feed is provided with a ground plane dielectrically spaced from the ground plane of the planar microwave circuit means to maintain the dielectric separation between the pair of relatively narrow side walls and the ground plane of the planar microwave circuit means.

5. The antenna rected in claim 4 wherein front ends of the pair of opposing, relatively wide walls of the waveguide have non-overlaying regions.

6. A radio frequency antenna comprising:

(a) a waveguide section comprising a pair of opposing, relatively wide walls and a pair of opposing, relatively narrow side walls;

(b) first means, disposed in the waveguide section, for establishing radio frequency energy in such waveguide section having a first linear polarization with an electric field disposed normal to the opposing wide walls of the waveguide section; and (c) second means, for establishing radio frequency energy having a second linear polarization with an electric field disposed perpendicular to the electric field of the first linear polarization, such second means comprising a microwave circuit including a strip conductor feed separated from a ground plane conductor by a dielectric, said second means being disposed within the waveguide section between the pair of opposing wide walls and relative to the first means to provide the radio frequency energy having the first linear polarization and the radio frequency energy having the second linear polarization with substantially coincident phase centers, said ground plane conductor being dielectrically spaced from the pair of opposing, relatively narrow side walls.

7. The antenna recited in claim 6 wherein the ground plane conductor has a notch formed therein fed by the strip conductor feed.

8. The antenna recited in claim 7 wherein the dielectric is a planar sheet of dielectric material having the ground plane conductor formed on one surface thereof and the strip conductor feed formed on the other surface thereof, and wherein the first means launches the first linearly polarized energy with the electric field thereof disposed in the E-plane of the waveguide and the planar dielectric sheet is disposed in the H-plane of the waveguide.

9. The antenna recited in claim 8 wherein a portion of the strip conductor feed of the microwave circuit passes through one of the pair of opposing, relatively narrow side walls of the waveguide section, and wherein such portion of the strip conductor feed is provided with a ground plane dielectrically spaced from the ground plane of the microwave circuit to maintain the dielectric separation between the pair of opposing, relatively narrow side walls and the ground plane of the microwave circuit.

10. The antenna recited in claim 6 wherein front ends of the pair of opposing, relatively wide walls of the waveguide section have non-overlaying regions.

11. A radio frequency antenna comprising:

(a) an electrically conductive waveguide section comprising a pair of opposing walls;

(b) feed means for establising ratio frequency energy in the waveguide section having a first linear polarization with an electric field disposed normal to the pair of opposing walls;

(c) microwave circuit means for establishing radio frequency energy in the waveguide section having a second linear polarization with an electric field disposed parallel to the pair of opposing walls, said microwave circuit means comprising a strip conductor circuit separated from a ground plane conductor by a dielectric, said microwave circuit means being disposed in the waveguide section intermediate the pair of opposing walls with the ground plane conductor being dielectrically separated from the electrically conductive waveguide section.

12. The radio frequency antenna of claim 11 wherein front ends of the pair of opposing walls of the waveguide section have non-overlaying regions.

13. In combination:

means for producing a pair of quadrature radio frequency signals; and radio frequency antenna means, responsive to the pair of quadrature radio frequency signals, for producing circularly polarized radio frequency energy, said radio frequency antenna means comprising:

(i) electrically conductive waveguide means comprising a pair of opposing, relatively wide walls;

(ii) feed means, resonsive to a first one of the pair of quadrature radio frequency signals, for establishing radio frequency energy in the waveguide means having a first linear polarization with an electric field disposed normal to the opposing wide walls of the waveguide means; and (iii) planar microwave circuit means, comprising a strip conductor feed separated from a ground plane conductor by a dielectric and fed by a second one of the pair of quadrature radio frequency signals, for establishing radio frequency energy having a second linear polarization with an electric field disposed perpendicular to the electric field of the first linear polarization, said microwave circuit means being disposed intermediate the pair of opposing, relatively wide walls with said ground plane conductor being dielectrically spaced from the waveguide means, said waveguide means producing circularly polarized radio frequency energy from the first linear polarization and the second linear polarization.

* * * * *